US012686519B2

(12) United States Patent
Hegde

(10) Patent No.: US 12,686,519 B2
(45) Date of Patent: Jul. 21, 2026

(54) CRIMPING DEVICE FOR SAFELY DISPOSING A CONTINUOUS LINER BAG CONTAINING TOXIC MATERIAL

(71) Applicant: Shreepad Hegde, Hyderabad (IN)

(72) Inventor: Shreepad Hegde, Hyderabad (IN)

( * ) Notice: Subject to any disclaimer, the term of this patent is extended or adjusted under 35 U.S.C. 154(b) by 0 days.

(21) Appl. No.: 18/860,054

(22) PCT Filed: Jun. 21, 2022

(86) PCT No.: PCT/IB2022/055750
§ 371 (c)(1),
(2) Date: Oct. 25, 2024

(87) PCT Pub. No.: WO2023/209430
PCT Pub. Date: Nov. 2, 2023

(65) Prior Publication Data

US 2025/0276819 A1 Sep. 4, 2025

(30) Foreign Application Priority Data

May 30, 2022 (IN) ..... 202241025439

(51) Int. Cl.
*B65B 51/14* (2006.01)

(52) U.S. Cl.
CPC ..... *B65B 51/146* (2013.01); *B65B 51/148* (2013.01)

(58) Field of Classification Search
CPC ..... B65B 51/146; B65B 51/148; B65B 61/26; B65B 2220/22; B65B 2220/20
See application file for complete search history.

(56) References Cited

U.S. PATENT DOCUMENTS 3,659,397 A * 5/1972 Mills ..... B67B 3/14 53/329
3,911,970 A * 10/1975 Lundberg ..... B25B 7/20 D8/44

(Continued)

FOREIGN PATENT DOCUMENTS

CN 106185105 B 7/2018
WO 2021162204 A1 8/2021

OTHER PUBLICATIONS

International Search Report mailed Nov. 2, 2023, issued in connection with International Application No. PPCT/IB2022/055750 (3 pages total).

(Continued)

*Primary Examiner* — Thomas M Wittenschlaeger
(74) *Attorney, Agent, or Firm* — Mendelsohn Dunleavy, P.C.; Steve Mendelsohn

(57) ABSTRACT

Implemented is a crimping device for safely disposing a continuous liner bag containing toxic material. The crimping device includes a female lobe, a male lobe, and two sleeves in which one is connectable with a semi-circular opening of the male lobe and the other is connectable with a semi-circular opening of the female lobe. The crimping device further includes cap movably connected with the male lobe and the female lobe. Furthermore, each of the sleeves is provided with matching ribs and serration in its interior. The female lobe and the male lobe are connected by engaging a hinge with twin hinges. Moreover, an underside of the cap body is stepped in construction to accommodate a blade, when assembled.

10 Claims, 7 Drawing Sheets

(56) References Cited

U.S. PATENT DOCUMENTS

| | | | | |
|---|---|---|---|---|
| 2006/0231211 | A1* | 10/2006 | Chou | B29C 65/224 156/583.1 |
| 2006/0248856 | A1* | 11/2006 | Cheng | B29C 66/8221 53/77 |
| 2010/0199602 | A1* | 8/2010 | Montano | B29C 66/876 53/374.2 |
| 2011/0252633 | A1* | 10/2011 | Dierks | G02B 6/3807 29/705 |
| 2018/0346169 | A1* | 12/2018 | Lank | B29C 66/431 |
| 2022/0200222 | A1* | 6/2022 | Kerstetter | H01R 43/0421 |
| 2022/0209482 | A1* | 6/2022 | Kao | H01R 43/0421 |

OTHER PUBLICATIONS

Written Opinion mailed Nov. 2, 2023 issued in connection with International Application No. PCT/IB2022/055750 (6 pages total).

* cited by examiner

CRIMPING DEVICE FOR SAFELY DISPOSING A CONTINUOUS LINER BAG CONTAINING TOXIC MATERIAL

CROSS-REFERENCES TO RELATED APPLICATIONS

This Non-Provisional Patent Application claims priority to and the benefit of PCT Application Serial No. PCT/IB2022/055750, filed Jun. 21, 2022, entitled "A Crimping Device for Safely Disposing a Continuous Liner Bag Containing Toxic Material," which claims the benefit of and priority to Indian Patent Application Serial No. 202241025439, filed Apr. 30, 2022, entitled "A Crimping Device for Safely Disposing a Continuous Liner Bag Containing Toxic Material," the entire contents of both applications of which are hereby incorporated herein by reference.

FIELD OF THE INVENTION

The present invention generally relates to devices involved in disposal of toxic materials harmful for humans and the environment. More particularly, the present invention relates to a crimping device for safely disposing a continuous liner bag containing toxic material.

BACKGROUND

Many chemicals are considered toxic and hazardous to the people working with them and to the environment due to presence of toxic active substances. The exposure due to unintended release of these hazardous chemicals can create undesired effect on the health of the workers and environmental damages. For example, in pharmaceutical industry, products or active ingredients are packed in plastic bags to transfer the product: inside to outside of the machine, outside to inside of the machine, one machine to another machine; one area to another production area; finish goods transportation to customers for delivery etc.

Typically, hazardous products are packed in multiple (layer of) bags or "bag inside the bag" or "bag in bag". First bag where the material is filled is called primary bag, then it is inserted into secondary and then into tertiary etc. LDPE/HDPE liner bags are normally used to pack. Stringent containment procedure have to be followed whenever toxic products are being packed or transferred.

When the liner is crimped and cut, a small portion of the secondary liner bag which is exposed to toxic product is now exposed to the operator/worker and the surrounding environment. Even when the bag is cut exactly at the crimp, the exposure is encountered. Since the product is toxic, even such small exposure may be beyond acceptable limit and could turn disastrous.

Majority of the containment breaches are recorded during process of introducing the product to the machine or during discharge from the machine. For Example, challenges of containment breach are faced while dispensing, sampling, or repacking of the toxic products etc.

The Continuous liner bag (CLB) a tubular, long (10-50 m) with both ends open, thin polyethylene bags are currently used to ensure the containment, during transfer of the product (in and out) of the machine. The continuous liner bags are attached to the machine, through a short tubular port called "liner port". One end of the CLB is always attached to liner port with O rings and other end then closed with cable tie. These long bags are then folded on the liner port.

After the manufacturing process, the toxic products are packed usually in primary bag and they are then put into the CLB. The CLB now acts as a secondary packing. The CLB is double crimped using two cable ties, cut in between the cable ties, and separated. The crimping with double cable tie ensures the product inside the continuous line bag remain sealed throughout the process. This procedure is followed to transfer product to inside the machine or to outside the machine. It is to be noted here that the primary bag is always contaminated, inside and outside. CLB which is secondary packaging is contaminated from inside only in this case.

As a practice Clamps or cable tie are used for closing the CLB. While cutting filled CLB, a small portion (excess length) of CLB remains outside the crimp area (beyond the cable tie/clamp/crimp area). The excess length of the secondary bag projecting out of the cable tie is now open to the atmosphere. This excess length beyond the crimped end of the bag is contaminated from inside and pose safety and health risk to the operator and to the environment. The excess length depends on the skill of the operator and the design of crimping accessories used, few millimetre to few inches. So there is very little complete solution available in the industry for transferring toxic and hazardous products.

To address the above mentioned problem with generic solution, some people have come out with solution to reduce the unintended exposure. Such solution provided have reduced the exposure but could not eliminate the exposure altogether. In place of cable tie, crimps are used to clamp the continuous liner bag. After crimping the bag, it is manually cut between the two crimps. Contaminated end face of the crimped bag will contaminate the clamp and crimping tools, operator hands, cloths etc causing the operator exposure. The particle sticking to the crimped & cut bag outside can fly and pose exposure risk. After cutting and separation of the bag, both ends of the crimps are then closed manually with a lid/cover. In between the process of cutting the bag & covering the ends with lid manually, crimp, tool etc., is contaminated, the exposure would have occurred, and operator may have come under risk.

The contaminated bag ends will further spread contamination to crimping tool, operator hands, bag outer surfaces and operator cloths etc., causing the unintended exposure. The exposure per bag may be very less, but when multiple bags are handled, the toxic level will cross acceptable limit. The gas inside the bag comes out through the crimp when pressed during the stacking. When the gas inside the secondary liner bag comes out, it may bring out odours and dust particles along with it. This will contaminate the entire area, exposure to all the people in the logistic chain such as packers, stackers, transporters, loaders etc. This solution is not suitable for transfer of very high toxic product.

Tampering of the existing crimp/cable tie is very easy. These crimps can be opened anytime during packing, storing and transportation, with simple pin or standard screwdriver. This is a serious safety issue. There is a definite scope for accidental or unintended opening or intentional opening for pilferage. Moreover, clamp can be re-crimped after opening without trace. Hence it to difficult definitively identify and trace the unauthorized opening.

It has multiple loose parts needs to be assembled in specific order. Current solution has at least 5-7 loose parts which needs to be assembled by the operator. It is very difficult to hold the bag and assemble crimp parts one by one and then crimp and cut with just one hand.

Multiple tools needs to be used for crimping and cutting. Separate tool for crimping and second tool for cutting and yet one more tool for capping etc. Different size clamps are required to crimp the different sizes of bags.

Existing clamp do not provide good crimping force. In many occasions they slip off the bag leading to major exposure accidents. This is a major cause of accidental exposure during logistics and transportation.

Therefore, there remains a need in the art to have a crimping device for safely disposing a continuous liner bag containing toxic material, which overcomes the aforesaid problems and shortcomings or at least provide a viable alternative.

SUMMARY

It is an object of the present invention to provide a crimping device for safely disposing a continuous liner bag containing toxic material.

Another object of the present invention is to provide a method of working of the crimping device.

Yet another object of the invention is to prevent exposure the product while transfer, closing, crimping and cutting of the bag.

Yet another object of the present invention is to crimp, cut and close the bag ends in a single operation to reduce number of stages of operation.

Yet another object of the present invention is to make the crimps tamper proof and to prevent re-use of the crimping device.

Yet another object of the present invention is to positively identify and establish traceability of the unauthorized opening of the bag any time during the life cycle of the crimping device.

Yet another object of the present invention is to provide a design to crimp bags of multiple sizes.

Yet another object of the present invention is to prevent accidental closure of the clamps before actual usage Yet another object of the present invention is to keep the bags latched together and interlink one bag to the crimping device of the other bags so as to ensure the bags are tacked together.

Yet another object of the present invention is to make the self-destructive clamps that provide multiple interlocks to prevent opening of the crimp once bag is crimped.

Yet another object of the present invention is to reduce the number of loose parts and simplify the assembly procedure for a crimping device.

Yet another object of the present invention is to prevent accidental escape or release of contaminated gases trapped inside the bag during handling or transportation.

Embodiments of the present invention aim to provide a crimping device for safely disposing a continuous liner bag containing toxic material. It should be understood here that though the disclosure throughout refers to the material/product to be stored in the liner bag as a toxic material, however, any other type of material could be stored in the liner bags including but limited to active pharmaceutical ingredients, speciality chemicals, speciality biologics, and the like.

In an example embodiment, the crimping device comprises a female lobe having a first body, ribs on a central semi-circular opening, a ratchet slot, a slider slot, a blade, a hinge, a latch finger an interlocking slot and and a latch guide; a male lobe having a second body, ribs inside the central semi-circular opening, a twin ratchet finger protruding from the first body, a slider, a flap, twin hinges, latch slot, stub, and a tag locator; two sleeves, one connectable with the semi-circular opening of male lobe and other connectable with the semi-circular opening of the female lobe, wherein each of the sleeves is provided with matching ribs and serration in an interior; and a cap movably connected with the male lobe and the female lobe, the cap having a cap body, double latch pins for self-locking with the latch pin locator, a cover, a cap hinge provided with a pin and a relief step provided on the cap body proximal to the hinge pin. Further, the female lobe and the male lobe are connected by engaging the hinge with the twin hinges. Also, an underside of the cap body is stepped in construction to accommodate a blade when assembled.

In accordance with an embodiment of the present invention, the crimping devices is configured to be assembled by engaging the latch finger of the female lobe in a space in the lower latch slot of the male lobe seamlessly.

In accordance with an embodiment of the present invention, two crimping devices are adapted to be assembled for use in crimping process, by engaging the female lobe of the first crimping device with the male lobe of the second crimping device in a front to front assembly, while the blade of first crimping device comes opposite to the blade of second crimping device, and the flap of the first crimping device come opposite to the flap of the second crimping device.

In accordance with an embodiment of the present invention, after assembly, the semi-circular openings are adapted to receive a continuous liner bag containing toxic product for crimping using a crimping tool. Moreover, as the crimping tool is operated, the male lobe and female lobe of start getting closed, the slider starts moving in the slider slot and the twin ratchet finger enters the ratchet slot. Further, as the male lobe and female lobe closes, the clamping force on the continuous liner bag increases, and gets shrunk and tightened inside the semi-circular opening of the crimping device. Furthermore, once the continuous liner bag cannot compress further, the blade of crimping device cuts the continuous liner bag and the cap is turned over the open end of the crimping device, thereby ensuring that the dissected end of continuous liner bag containing the toxic product is never exposed even during cutting.

In accordance with an embodiment of the present invention, the crimping tool comprises, but not limited to, two scissor handle, a ratchet arm and a guiding arm to guide the continuous liner bag into the crimping device.

In accordance with an embodiment of the present invention, the twin ratchet finger of the male lobe is split into an upper portion and lower portion, with a gap in between to have expansion effect when engaged with a ratchet in the ratchet slot of the female lobe. Additionally, an inner side of the twin ratchet finger is plain to ensure not to obstruct the bag movement inside and an outer part is provided with a ratchet to enable irreversible interlocking with the ratchet.

In accordance with an embodiment of the present invention, the slider of the male lobe is provided in a way to prevent the continuous liner bag from moving and clogging the hinges when the female lobe and the male lobe are forced to close by crimping tool.

In accordance with an embodiment of the present invention, the female lobe includes a canopy at a top, to cover any gaps between the female lobe and the male lobe. Also, the canopy overlaps the gap and locates itself on step provided on male lobe covering any gaps left while crimping.

In accordance with an embodiment of the present invention, the male lobe includes an S flange Cover to cover the gaps at the one end of twin ratchet finger and at the slider. Further, the S flange is configured to block any access to the twin ratchet finger to prevent any forceful opening, thus making the crimping device tamper-proof.

In accordance with an embodiment of the present invention, the male lobe, the female lobe and the cap are made of a material selected from, but not limited to, PU, PVC, PP, and Nylon; and the sleeves are made of a flexible material such as, but not limited to, silicone or any polymer.

BRIEF DESCRIPTION OF THE DRAWINGS

So that the manner in which the above recited features of the present invention can be understood in detail, a more particular to the description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, the invention may admit to other equally effective embodiments.

These and other features, benefits and advantages of the present invention will become apparent by reference to the following text figure, with like reference numbers referring to like structures across the views.

DETAILED DESCRIPTION

Figure 1A:
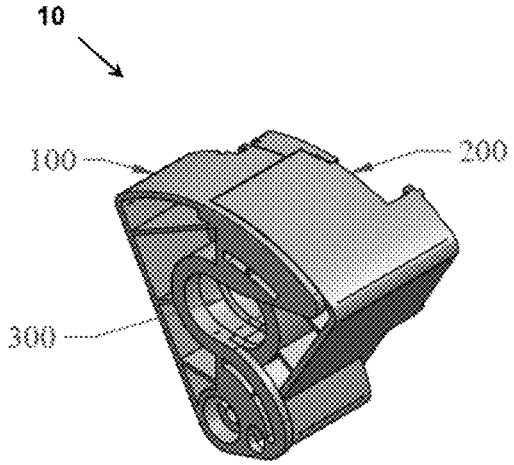
FIG. 1A-1B illustrate a closed condition of a crimping device for safely disposing a continuous liner bag containing toxic material from back and front perspective views, respectively in accordance with an embodiment of the present invention.

While the present invention is described herein by way of example using embodiments and illustrative drawings, those skilled in the art will recognize that the invention is not limited to the embodiments of drawing or drawings described and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modification/s, equivalent/s and alternative/s falling within the scope of the present invention as defined by the appended claim. The headings used herein are for organizational purposes only and are not meant to be used to limit the scope of the description or the claim. As used throughout this description, the word "may" is used in a permissive sense (i.e. meaning having the potential to), rather than the mandatory sense (i.e. meaning must). Further, the words "a" or "an" means "at least one" unless otherwise mentioned. Furthermore, the terminology and phraseology used herein is solely used for descriptive purposes and should not be construed as limiting in scope. Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the likes are included in the specification solely for the purpose of providing a context for the present invention. It is not suggested or represented that any or all of these matters form part of the prior art base or were common general knowledge in the field relevant to the present invention.

In this disclosure, whenever an element or a group of elements is preceded with the transitional phrase "comprising", it is understood that we also contemplate the same composition, element or group of elements with transitional phrases "consisting of", "consisting", "selected from the group of consisting of", "including", or "is" preceding the recitation of the composition, element or group of elements and vice versa.

The present invention is described hereinafter by various embodiments with reference to the accompanying drawing, wherein reference numerals used in the accompanying drawing correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art. In the following detailed description, numeric values and ranges are provided for various aspects of the implementations described. These values and ranges are to be treated as examples only and are not intended to limit the scope of the claims. In addition, a number of materials are identified as suitable for various facets of the implementations. These materials are to be treated as exemplary and are not intended to limit the scope of the invention.

Figure 1B:
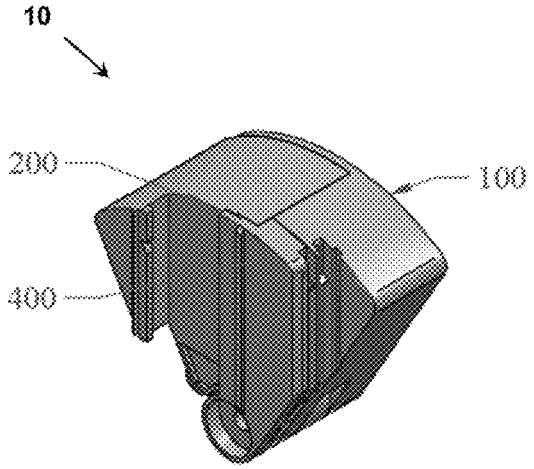
Figure 1C:
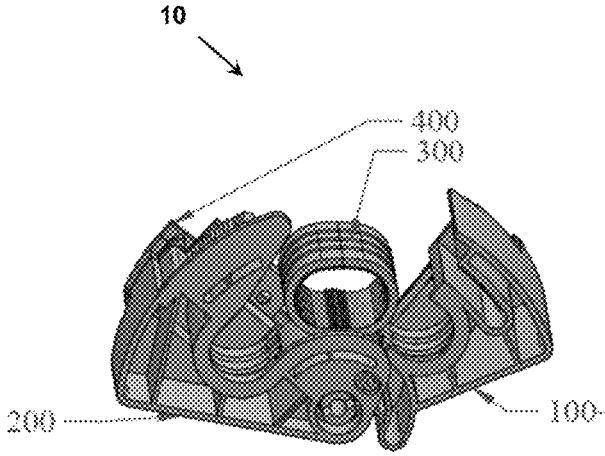
FIG. 1C-1D illustrate an open condition of the crimping device of FIG. 1A-1B from back and front perspective views, respectively in accordance with an embodiment of the present invention.
Figure 1D:
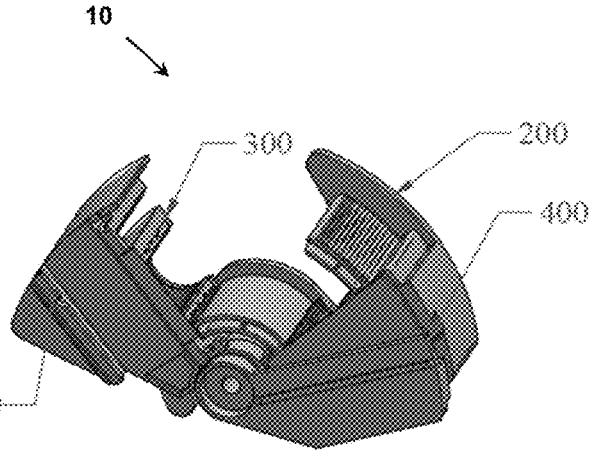

FIGS. 1A-1B illustrate a closed condition of a crimping device for safely disposing a continuous liner bag containing toxic material from back and front perspective views, respectively in accordance with an embodiment of the present invention. It should be understood here that though the disclosure throughout refers to the material/product to be stored in the liner bag as a toxic material, however, any other type of material could be stored in the liner bags including but limited to active pharmaceutical ingredients, speciality chemicals, speciality biologics, and the like. Furthermore, FIGS. 1C-1D illustrate an open condition of the crimping device of FIGS. 1A-1B from back and front perspective views, respectively in accordance with an embodiment of the present invention.

As shown in FIGS. 1A-1D, the crimping device (10) comprises a female lobe (100); a male lobe (200) connected with the male clamp (102); two sleeves (300), one connected with the female lobe (100) and one connected with the male lobe (200); and a cap (400) movably connected with the male lobe (200) and the female lobe (100). Each of the above mentioned components will now be described in detail with reference to accompanying drawings.

Figures 2A, 2B:
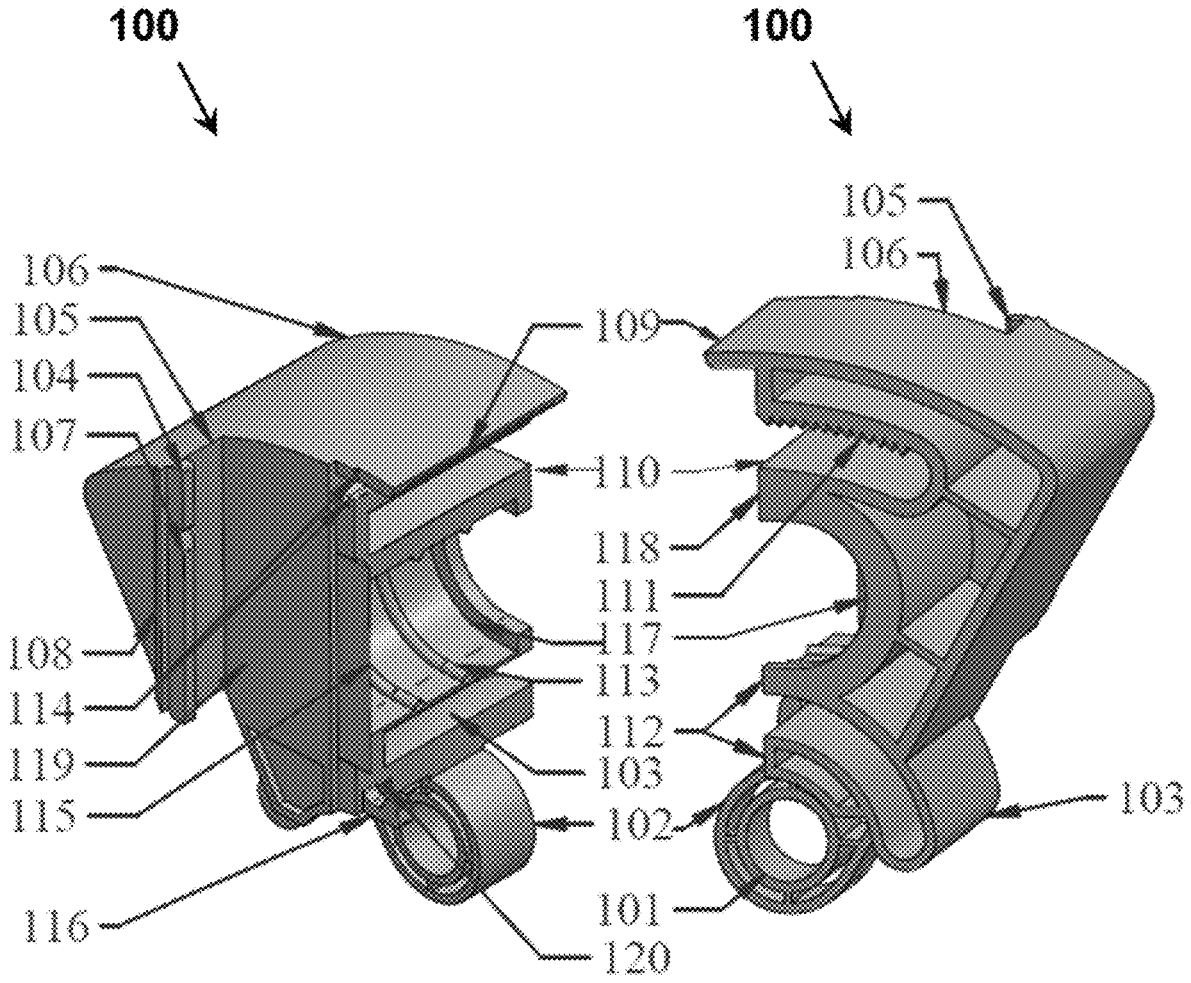
FIG. 2A-2B illustrate a female lobe of the crimping device from front and back perspective views, in accordance with an embodiment of the present invention.

FIGS. 2A-2B illustrate a female lobe of the crimping device from front and back perspective views, in accordance with an embodiment of the present invention. As shown in FIGS. 2A-2B, the female lobe (100) comprises a first body (106), a rib (113) on central semi-circular opening (117), a ratchet slot (110), a slider slot (103), a blade (115), a hinge (102), a latch finger (104), an interlocking slot (105) and a latch guide (108). Herein, the inner surface of the central semi-circular opening (117) of the female lobe (100) is provided with ribs (113). The ribbed contour is provided to fix/receive one of the sleeves (300). The sleeve (300) is provided with matching ribs (304). Also, a shape of the semi-circular opening (117) in the female lobe (100) is optimized to comfortably move the continuous liner bag inside and fit into the shape.

As can be seen from the FIGS. 2A-2B one side of the semi-circular opening (117) is open to receive the continuous liner bag, and the other side is closed with the cutting blade (115). The blade (115) is fixed inside the flap (119) and is slightly projected out. Furthermore, the rectangular shaped ratchet slot (110) and the rectangular slider slot (103) are provided on the female lobe (100). The upper side of the ratchet slot (110) is provided with a ratchet (111). Herein, one side of the ratchet slot (110) is closed with latch pin locator (114) and other side is open. The rectangular slider slot (103) is semi-circular in shape and is provided with a guide (112) on both sides.

Moreover, the latch finger (104) is provided on the blade end side of the first body (106) of the female lobe (100). The latch guide (108) is provided on the side wall of the female lobe (100). The interlock slot (105) is created in the female body (100) with latch finger (104). The first body (106) of the female lobe (100) is also provided with an extended canopy (109). The latch pin locator (114) is provided to the underside of the extended canopy (109). In addition, there is a female locator-1 (107) and latch guide (108) provided on the latch finger (104) of the female lobe (100). Furthermore, a cap guide (120) is a spiral upward slot provided at the back of the hook (116).

Figure 3A:
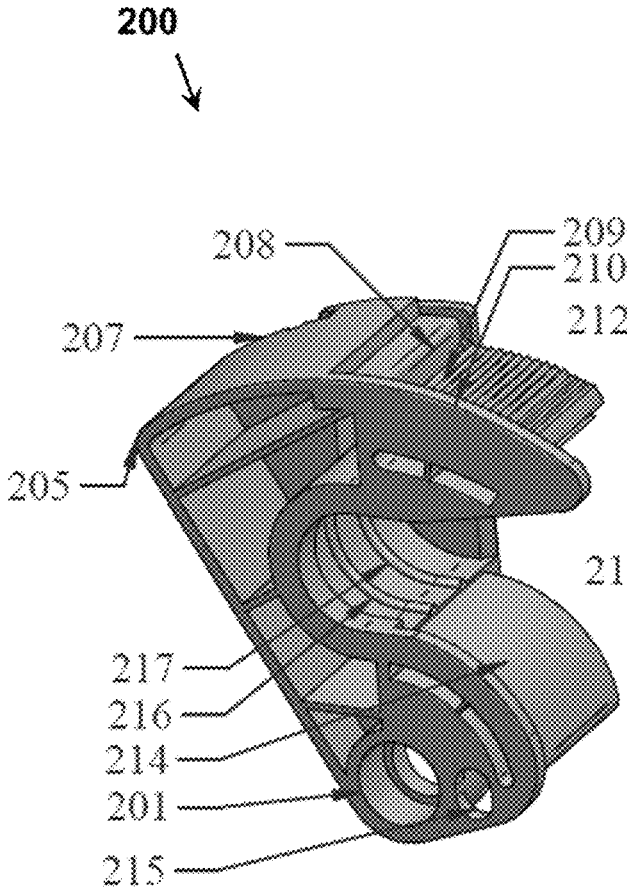
FIG. 3A-3B illustrate a male clamp of the crimping device from front and back perspective views, in accordance with an embodiment of the present invention.
Figure 3B:
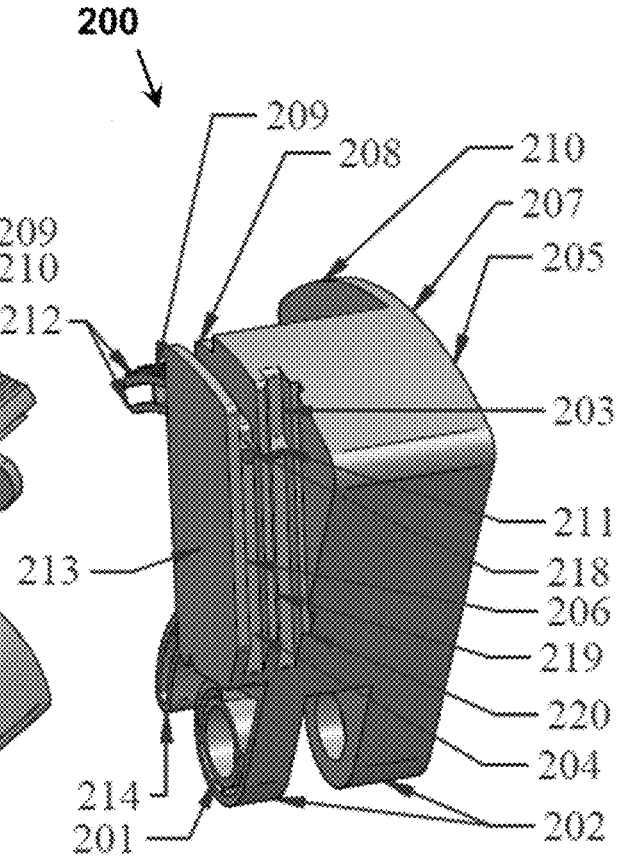

Then, FIGS. 3A-3B illustrate a male clamp (200) of the crimping device (10) from front and back perspective views, in accordance with an embodiment of the present invention. As shown in FIGS. 3A-3B, the male lobe (200) may a triangular shaped male lobe body (207) with smooth rounded corners (205). The male lobe (200) further comprises ribs (216) inside a central semi-circular opening (217), twin ratchet finger (212), a slider (214), a flap (213), twin Hinges (202), latch slots (203, 204), stubs (211, 218), a tag locator (215). An Inner surface of the central semi-circular opening (217) is provided with the ribs (216). The ribbed contour is provided to fix/receive one of the sleeves (301). The sleeve (301) is provided with the matching ribs (304). The sleeve (301) is also provided with serration inside (303).

Further, the twin ratchet finger (212) is slightly curved in shape and split into two portions—an upper portion and a lower portion. This will expand when engaged and will hold effectively with ratchets (111) on the ratchet slot (110) of the female lob. The inner side of the ratchet finger (212) is plain and outer part is provided with ratchet (209) which engages with the ratchet (111) in female lobe (100). It can be observed that a small gap is provided between the two portions of the split ratchet finger (212) to have expansion effect when engaged with ratchet (111 & 209) to enable unidirectional interlocking. Herein, one side of the ratchet finger (212) is attached 'S' Flange cover (210) and other side is open.

Furthermore, a step (208) is provided on the male body (207) at the beginning of the ratchet finger (212). Herein, one side of the semi-circular opening (217) is open to receive the bag, while the other side is closed with a flap (213). The flap (213) is provided to effectively cover the cut end of the continuous liner bag during usage as soon as it is cut by the blade (115). The flap (213) acts as a barrier to prevent the exposure of the toxic product inside the continuous liner bag.

The slider (214) in a curved shape, is provided below the ratchet finger (212). One side of the slider (214) is covered with the 'S' flange cover (210) and other side is open. The slider (214) is provided to guide the male lobe (200) and the female lobe (100) to cover the hinges. Herein, the inner side of the S flange (210) is provided with the tag locator (215) that can be identified as a small oval hole near the hinge (201).

Further, an upper latch slot (203) and a lower latch slot (204) are created by latch socket (219 & 206). Besides, a latch guide socket (220) is provided on front side wall of male lobe (200). These are provided for interlocking of the male lobe (200) and the female lobe (100) and to provide grip when interlocked. Herein, the stub-1 (211) is provided on the lower latch slot (203) and a lower latch socket (219) is provided on a front side of the male lobe (200). Also, the stub-2 (218) is provided on the lower latch socket (219).

Figures 4A, 4B:
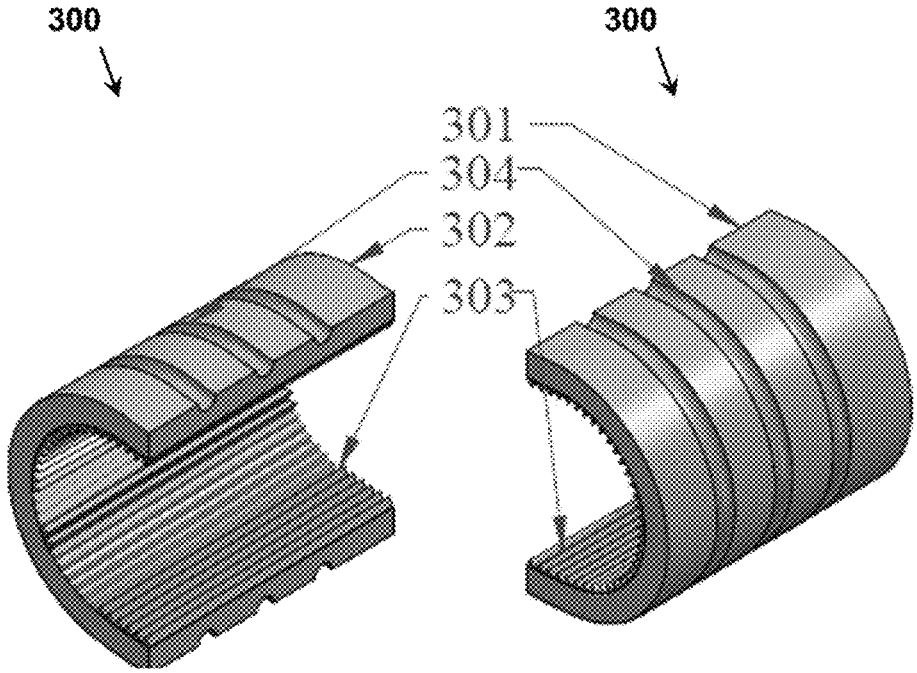
FIG. 4A-4B illustrate sleeves of the crimping device from front and back perspective views, in accordance with an embodiment of the present invention.

FIGS. 4A-4B illustrate sleeves (300) of the crimping device (10) from front and back perspective views, in accordance with an embodiment of the present invention. As can be seen from the FIGS. 4A and 4B, two sleeves (301, 302), one connectable with the semi-circular opening (217) of male lobe (200) and other connectable with the semi-circular opening (117) of the female lobe (100). Herein, each of the sleeves (300) provided with matching ribs (304) and serration (303) in an interior. The sleeve (301) is provided with matching ribs (304) to fix with the semi-circular opening (217) of the male lobe (200). The sleeve (302) is to be fixed with the semi-circular opening (117) of the female lobe (100).

The sleeves (301, 302) are flexible and may be made of, but not limited to, silicone or any soft polymer and are designed to adjust the semi-circular opening (217,117) area of the male lobe (200) and the female lobe (100). The sleeve (301, 302) can be used whenever required. If the secondary bag (603) size is large (i.e., after crimping, the liner requires more area in the semi-circular openings 217, 117), the sleeves (301, 302) can be removed. When bag (603) size is lesser, the sleeve (300) can be inserted to get required clamping force. The Sleeves (301 302) have serration (303) on inner side to prevent the bag slippage. The sleeve (301, 302) material increases the friction with the secondary bag (603) ensuring better grip. The higher gripping force friction will reduce the chances of clamp (100) slipping out during the handling of the continuous liner bag (603).

Figures 5A, 5B:
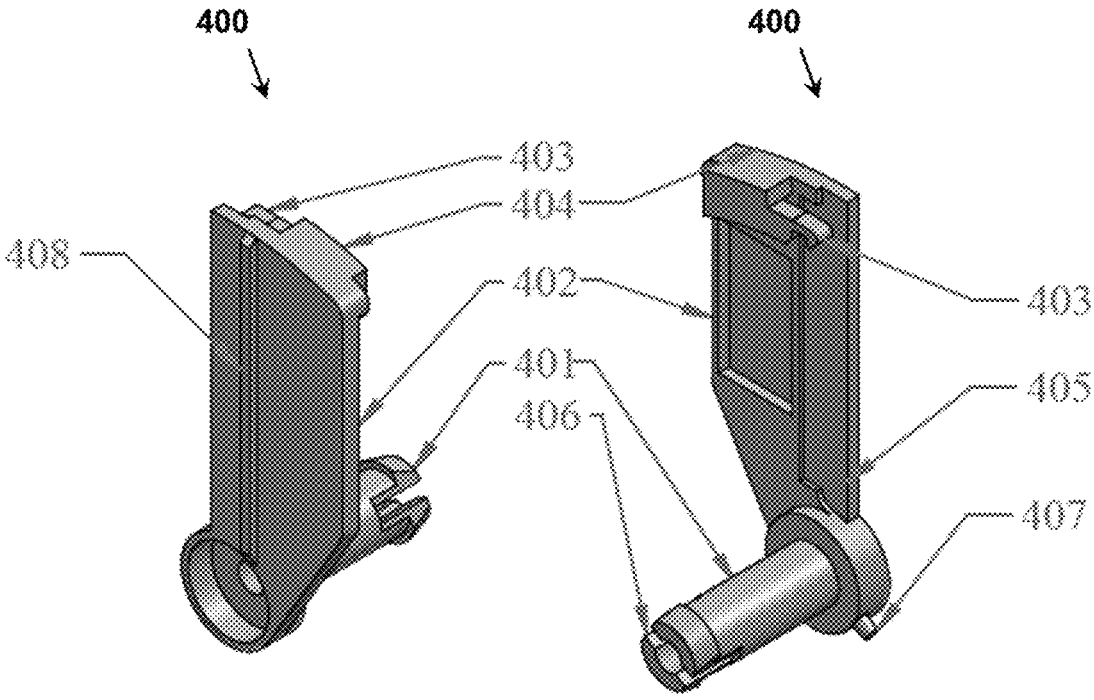
FIG. 5A-5B illustrates a cap of the crimping device from front and back perspective views, in accordance with an embodiment of the present invention.

FIGS. 5A-5B illustrates a cap of the crimping device from front and back perspective views, in accordance with an embodiment of the present invention. As shown in FIGS. 5A-5B, a cover (404) and a cap hinge (401) are integral part of the cap (400). The cap hinge (401) has a split head (406)

to make it self-lock type. A relief step (405) is provided on the cap body (402) near the cap hinge (401). It is provided with double latch pins (403) for self-locking with a latch pin locator (114). Under side of the cap body (402) is slightly stepped in construction to accommodate the blade (115) when assembled. A cap hinge (401) is provided with a pin (407) on the top of the body. A rib (408) is provided on the cap.

These components are assembled to form the crimping device (10) as shown in FIGS. 1A-1D. Referring back to FIGS. 1A and 1C, it can be observed that the back of the crimping device (10) is designed for holding the continuous liner bag and the front of the crimping device (10) (refer FIGS. 1B and 1D) is designed for cutting and closing. The FIG. 1C represents open condition of the crimping device (10) from the back and FIG. 1D represent open condition of the same crimping device (10) from the front.

Figure 6A:
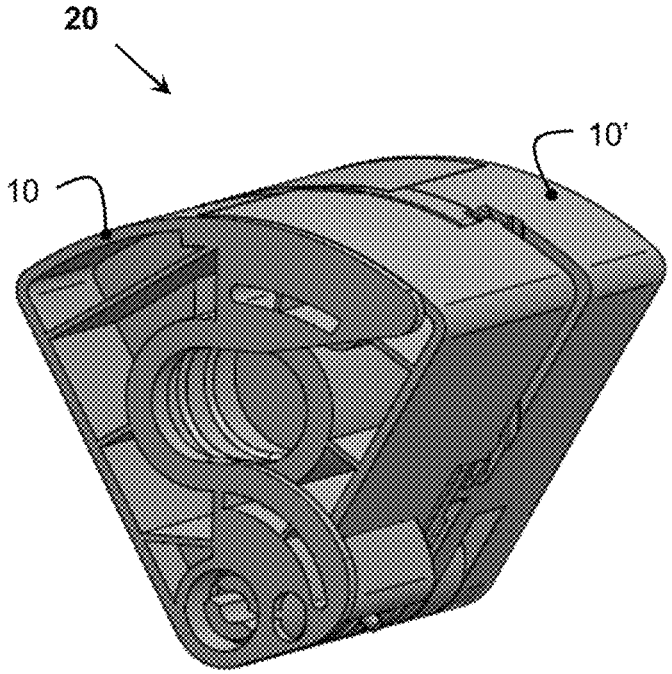
FIG. 6A-6B illustrate an assembly of two crimping devices in closed and open positions respectively, in accordance with an embodiment of the present invention.

Essentially the male lobe (200) of the first crimping device (10) and the female lobe (100) of the first crimping device (10'), and male lobe (200) of the second clamp and female lobe (100) of the first clamp are latched together front to front before inserting it into the crimping tool. The lobes (100,200) are initially in open condition (FIG. 6A). The open crimping devices (10. 10') are brought together front to front, so that latch finger (104) engages with upper latch slot (203) and latch guide (108) with latch guide socket (220) with a click, at the same time the female locator (107) engages with stub-1 (211). The engagement prevents sliding as well as coming out easily. The assembly can be disassembled with slight twist with a click of sound.

It should be noted that a single crimping device (10) is perfectly capable of crimping various kinds of bags and has numerous applications. However, in applications for disposing continuous liner bags containing toxic products, most of the time two crimping devices (10) are joined together and placed on the continuous liner. For example, one part of the continuous liner contains a toxic hazardous waste which needs to be disposed. So, two crimping devices (fully engaged male lobe (200) and the female clamp (100)) are joined placed in series and close to each other on the continuous liner.

Figure 6B:
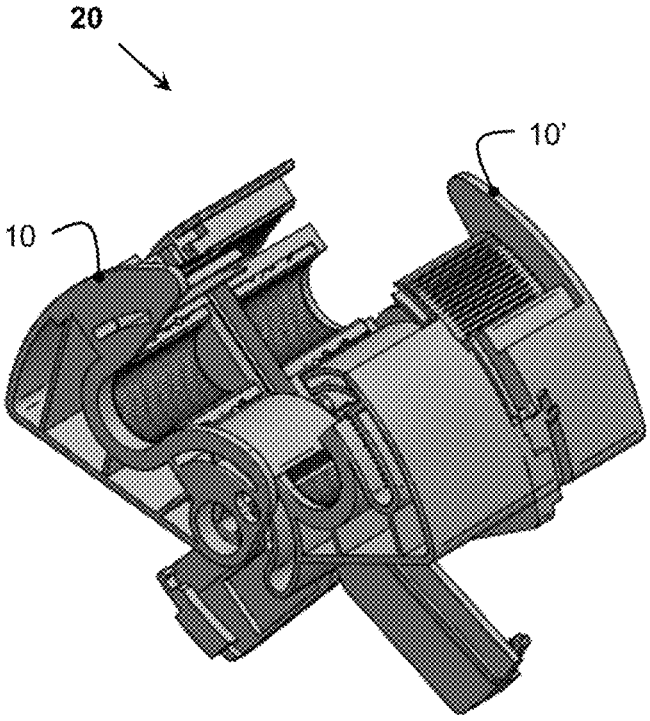

Therefore, FIGS. 6A-6B illustrate an assembly (20) of two crimping devices (10, 10') in closed and open positions respectively, in accordance with an embodiment of the present invention. Herein, FIG. 6A represent the latched and closed positions of the two sets of crimping devices (10) (together labelled with reference numeral "20") and FIG. 6B represents the open position. The crimping device (10) is designed to assemble 'front-to-front' i.e., front of the first crimping device (10) is latched to the front of the second crimping device (10).

In the front-to-front latched condition (refer FIG. 6B), the flap (213) of first crimping device (10) come beside the flap (119) of second crimping device (10') and vis-a-versa. That means, the blade (115) of first crimping device (10) comes opposite to the blade (115) of second crimping device (10'), the flap (213) of the first crimping device (10) come opposite to the flap (213) of the second crimping device (10'). This essentially means, the female lobe of the first crimping device (10) (100) will get engaged with male lobe (200) of the second crimping device (10') in front to front assembly.

The latch finger (104) of the first crimping device (10) engages in the space in the lower latch slot (204) of the second crimping device (10') seamlessly and is designed to ensure proper and correct assembly (20) of two crimping devices (10, 10') together. The female locator-1 (107) of the first crimping device (10) gets engaged (with click sound) with stub-1 (211) of the male lobe (200) of the second crimping device (10'). The engagement of the stub-1 (211) and the female locator-1 (107) ensure they do not slip away easily. They will come out only when sufficient twist is provided with click of sound. Essentially the male lobe (200) of the first clamp and female lobe (100) of the second clamp are latched together front to front before inserting it into a crimping tool.

Figure 7:
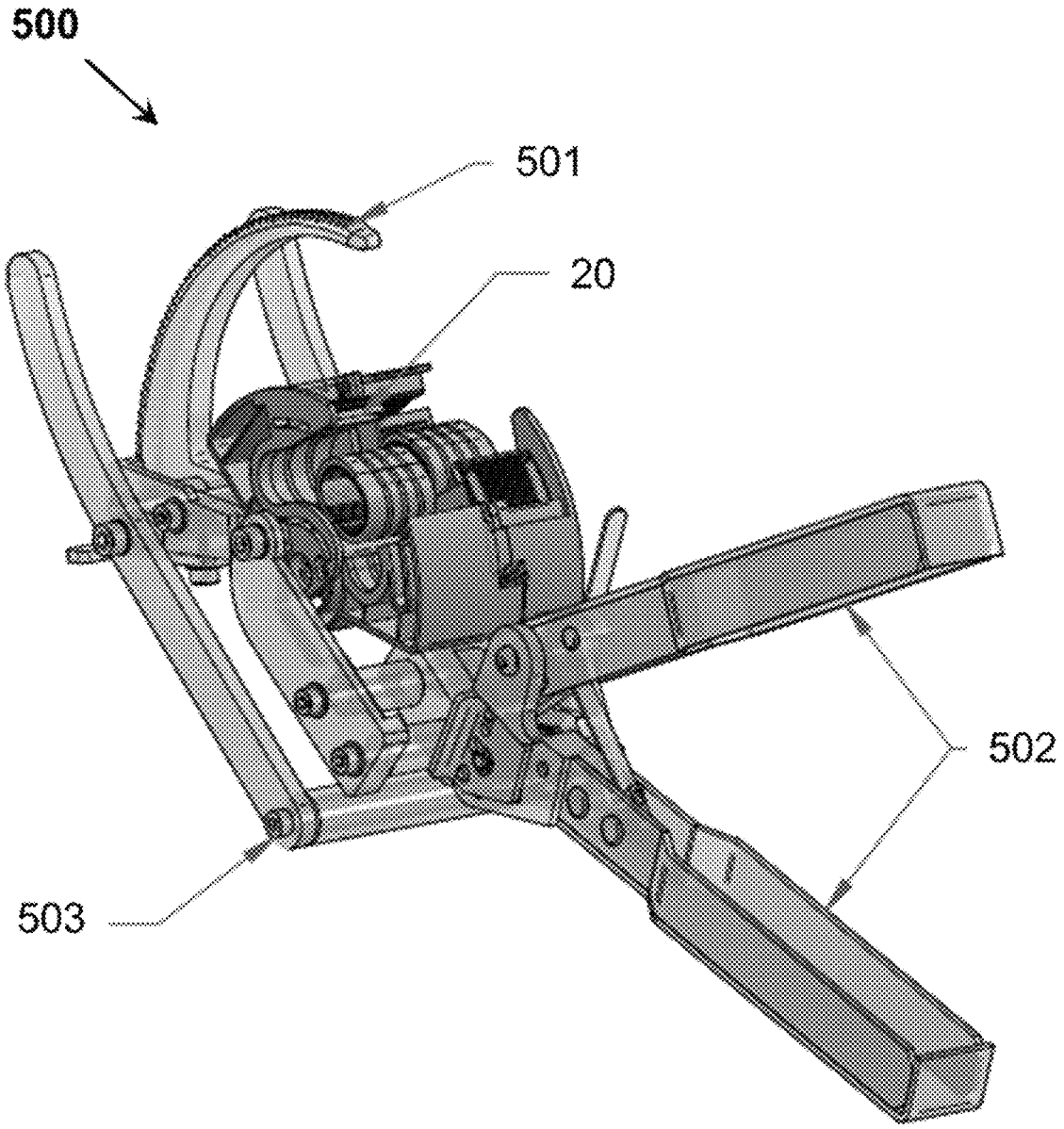
FIG. 7 illustrates a crimping tool to be used with the crimping device, in accordance with an embodiment of the present invention.

FIG. 7 illustrates the crimping tool (500) to be used with the crimping device assembly (20), in accordance with an embodiment of the present invention. The existing readily available crimping tool is modified to suite the current application. The two sets of assembled (front to front) crimping devices (10, 10') can be easily located inside the crimping tool (500). The crimping tool (500) selected uses the ratchet and pinion (501) to reduce the load on the operator's hand during crimping process. The crimping tool (500) has two scissor handle (502). When the scissor action on the handle (502) is made, the ratchet arm (501) starts closing in on the crimping device assembly (20). The crimping tool (500) is provided with a guiding arm (503) to guide the continuous liner bag into crimping device assembly (20).

Figure 8A:
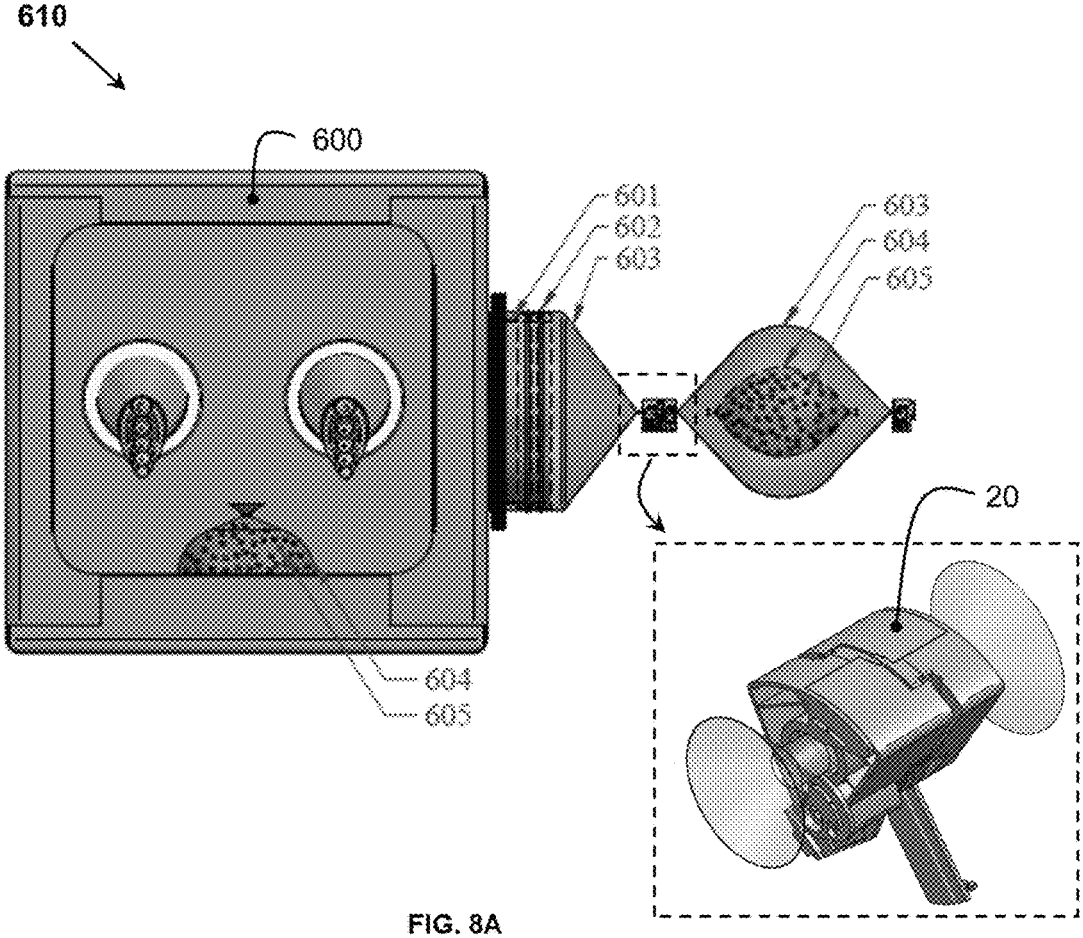
FIG. 8A-8C illustrate a method of working of the crimping device for safely disposing the continuous liner bag, in accordance with an embodiment of the present invention.
Figure 8B:
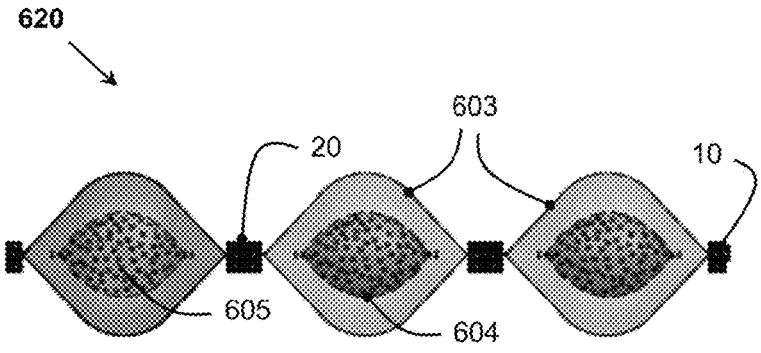
Figure 8C:
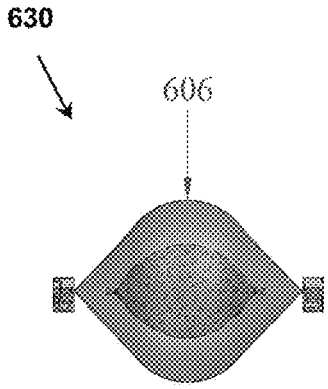

FIGS. 8A-8C illustrate a method of working of the crimping device (10) for safely disposing the continuous liner bag, in accordance with an embodiment of the present invention. The following explanation illustrates a practical implementation of the assembly (20) of the crimping devices (10, 10') in a containment transfer system. A typical containment transfer system (600) is shown in the FIG. 8A. A continuous liner bag (603) is attached to a continuous liner port (601) with an O ring (602). The primary bag (604) which will be contaminated inside/outside due to direct contact with the product (605). Continuous liner bag (603) is contaminated only from inside due to the contact with the inside environment of containment system (600). The continuous liner bag (603) is also called as a secondary bag. The toxic product (605) is first packed in a primary bag (604) and then transferred out from the machine into the continuous liner bag (603). The product (605) is first packed in the primary bag (604). The primary bag (604) with the product (605) is then transferred into the continuous liner bag (603) (or the secondary bag) through continuous liner port (601). The secondary bag (603) is now shrunk with hand near the continuous liner port (601). The continuous liner bag (603) is then crimped and cut, before taking out the product (605) in the primary bag (604). Both ends of the secondary packing (603) is crimped similar to the chocolate packing (606, FIG. 8C).

However, in the present invention, the crimping tool (500) is assembled ready with two sets (10, 10') of front to front latched crimping device (20) in open condition are brought to continuous liner port (601) of the containment equipment (600). The continuous liner bag (603) is twisted and pushed inside the clamps semi-circular area (217,117) with the help of crimping tool bag guide (503). Once the secondary bag (603) is completely inside the open clamp, the crimping tool (500) is slowly closed with scissor action (502). The ratchet arm (501) pushes the crimping device assembly (20), and the crimping device assembly (20) starts closing slowly with every scissor action with the continuous liner bag (603) inside.

When the crimping tool (500) is operated, the male lobe (200) and female lobe (100) of both the crimping devices (10, 10') respectively starts getting closed. The slider (214) starts moving in the slider slot (103). At the same time twin ratchet finger (212) enters the ratchet slot (110). The ratchets (111 & 209) start getting engaged. The ratchets (111, 209) are designed so that it can engage in forward direction. With each scissor action of the crimping tool (500), as the female lobe (100) and the male lobe (200) come closer, the clamping force on the secondary bag (603) increases, the secondary bag (603) gets shrunk and tightened inside the semi-circular openings (117, 217) of the crimping device assembly (20). When the female lobe (100) and the male lobe (200) get sufficiently closed, the secondary bag (603) get fully crimped and becomes like a rod. At this moment, the blade (115) on both the crimping devices (10, 10') of the assembly (20) starts pushing the secondary bag (603) towards the flap (213) of both the crimping devices (10, 10') respectively. When the secondary bag (603) cannot compress further, the blade (115) of both the crimping devices (10, 10') starts cutting the secondary bag (603). The crimping tool (500) is designed such way that once secondary bag (603) is cut and crimping devices (10, 10') are closed, further scissor action will not be possible. Then, the ratchet (501) is released and crimping device assembly (20) are taken out in latched, crimped and closed condition in front-to-front assembled (FIG. 8A) condition, with closed secondary bags (603) attached, as shown in FIG. 8B. With the slight twist and pull, the two closed crimping devices (10, 10') can be detached with click sound. Now the respective caps (400) are turned over the crimped clamps. When the cap (400) is turned to close, guide pin (407) slides spirally up inside cap guide (120). Upon pushing the cap (400) further, the latch (403) gets engaged with latch pin locator (114) with a click of sound. This will lock the caps (400) and crimping devices (10, 10') irreversibly. The secondary bags (603) are now independent of each other (in cut and closed condition) as shown in FIG. 8C. Each separated secondary bag (603) has one crimping device (10) at both ends. This completes the crimping and cutting action.

The unique feature of the present invention is that during cutting, the cut end face of the secondary bag (603) starts flowing behind the flap (213) and the flap (119) of both the crimping devices (10, 10'). The blade (115) on the female lobe not only cuts the secondary bag (603), simultaneously it closes the cut end face of the secondary bag (603). The dissected portion of the secondary bag (603) sink inside the semi-circular opening (117, 217) which gets covered with flap (213) in male lobe (200) and the flap (119) in female lobe (100) of both the clamps. The cutting action and covering action takes place simultaneously and instantaneously. This ensures the secondary bag (603) dissected end is never exposed, i.e., bag cut end face is not exposed even during cutting.

This design ensures there is no gap between two attached crimping devices (10, 10') as shown in FIGS. 6A-6B. When the secondary bag (603) is completely cut, the male and female lobs (200, 100) of both the crimping devices (10, 10') get fully engaged, the flap (213) and the flap (119) get overlapped leaving no gap on the cut end face i.e., front view. Because of the positive engagements of the ratchets (111, 209), the female lobe (200) and male lobe (200) cannot be disengaged/opened again. It remains closed forever. This is because when the female lobe (200) and male lobe (200) are pushed towards each other, the ratchet finger (212) enters the ratchet slot (110) and ratchets (209,111) gets engaged. These are unidirectional ratchets (209,111).

Further, the slider (214) is provided to cover the hinges (202). The slider (214) is provided such a way that it will prevent the secondary bag (603) (or the continuous liner bag (603)) from moving and clogging the hinges (202, 102) when the female and male lobes (100, 200) are forced to close by the crimping tool (500). The extended canopy (109) provided on the female lobe (100) covers any gaps between the female and the male lobes (100, 200) at the top. The extended canopy (109) overlaps the gap and locates itself on step (208) provided on male lobe (200) during crimping, thereby covering any gaps left while crimping. The S flange Cover (210) covers the gaps at the one end of ratchet finger (212) and at the slider (214). The secondary bag (603) and ratchet (111, 209) are not visible when clamped, due to the presence of S flange (210). The S Flange cover (210) also effectively blocks any access to the ratchet finger (212) preventing forceful opening. The S flange cover (210) thus makes the assembly tamper-proof. It also covers the crimped portion of the secondary bag (603) completely and gives good aesthetic look.

The hinges (102, 202) are provided on both female lobe (100) and male lobe (200). The stepped hinge hole (201) is provided in the male lobe (200). The split head (406) of hinge pin (401) expands and locks with the stepped hinge hole (201). This prevents accidental or intentional removal or opening of cover (400). Once engaged, the split head (406) expands and cannot be removed from the stepped hinge hole (201). It gets self-locked, thereby providing another tamper proof lock.

The design of the crimping device (10) ensures that there is no excess material retained beyond the clamp. The blade (115) on the female lobe (100) is provided to cut the crimped bag (603). It not only cuts the crimped bag (603), but also pushes the bag behind the flap (213, 119), thus effectively preventing any exposure of the cut end to the surrounding or the operator. The cutting and sinking behind flap (213, 119) takes place simultaneously and instantaneously. Sufficient overlap is provided between the flap (213) and blade (115) in closed condition in the front side. The cutting, sinking and the overlap ensures that there is no exposure of the dissected end of the secondary bag (603) anytime (FIGS. 8A-8C) during closing, crimping, or cutting.

When the female and male lobes (100, 200) are closed, dissected end of the secondary bag (603) will be completely closed by blade (115), flap (119, 213) without leaving any space for exposing the secondary bag (603). The cap (402) is provided for physical safety of the operator to cover the blade (115). The cap (402) is turned over the closed crimping device (10) till it gets locked (as shown in FIG. 1B). When the cap (402) is fully engaged, latch pin (403) on the cap body (402) goes and latch onto the latch pin locator (114) provided on the female lobe (100). Latch pin (403) and latch pin locator (114) are provided in the inaccessible place to prevent any opening once engaged. This is another tamper proof interlock. This will not only prevent cap (402) opening but also give secondary lock to the clamps (100, 200). The cap (400) serves two purposes. One to cover the blade for physical safety of the operator and second to give secondary interlock to the clamps (100 & 200) so that it cannot be opened once closed. They are designed such a way, that forceful disengagement will break the latch pin (403).

The ratchet (209, 111) prevents disengagement of the clamps. They are designed such a way, that forceful disengagement will break the ratchet. Another interlock.

The design prevents accidental or unintentional closure of clamps (100, 200) or cap (400). The unintended closure leads to wastage of the clamps. During handling or during logistics there are possibilities for clamps to getting engaged accidently or unknowingly (without bag). The unintended closed crimping device (10) without bag is waste of resource and is a loss. The hook (116) provided on female lobe (100) will obstruct the male lobe (200) while closing in normal condition. With little excess pressure hook (116) will tend to bend and allow lobes (100) & (200) get engage. Only when sufficient load is intentionally applied to close further, the hook (116) lead to the permanent closure of the crimping device (10).

Once the continuous liner bag (603) is crimped, cut and cap is closed, the crimping process is over. The two separate closed bags with the crimping devices (10, 10') can be latched together again as shown in FIG. 8B. The latch finger (104) slides in the lower latch slot (204) (of both clamps) till the end so that female locator (107) get engaged with stub-2 (218) with slight sound of click. The engagement of stub-2 (218) and female locator (107) ensures two latched clamps remain in position. The rib (408) is provided to prevent the latched clamps do not come out. The rib (408) on one cap foul with rib (408) on the another clamp and prevent the clamps coming out. This unique feature makes the series of bag engaged together like a chain as shown in FIG. 8B. Whenever required these latched bags can be detached easily as shown in FIG. 8C, by slight twisting and pulling the clamps so that the latches stub-2 (218) and female locator (107) get dislodged and starts sliding out.

In accordance with an embodiment of the present invention, the tag locator (215) is provided on the male lobe (200) near the hinge hole (201). Once the crimping is over, the bag identifier tag can be attached using tag locator (215) for user identification number for each bag. Bag identifier tag is used for identification of the content like product name, manufacturing expiry date etc.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be provided broadest scope consistent with the principles and the novel and inventive features disclosed or suggested herein. Accordingly, the invention is anticipated to hold on to all other such alternatives, modifications, and variations that fall within the scope of the present invention and appended claims.

The invention claimed is:

1. A crimping device for safely disposing a continuous liner bag containing toxic material, the crimping device comprising:

a female lobe having a first body, ribs on a central semi-circular opening, a ratchet slot, a slider slot, a blade, a hinge, a latch finger, an interlocking slot and a latch guide;

a male lobe having a second body, ribs inside a central semi-circular opening of the male lobe, a twin ratchet finger protruding from the second body, a slider, a flap, twin hinges, a latch spot, a stub, and a tag locator;

two sleeves, one connectable with the semi-circular opening of male lobe and other connectable with the semi-circular opening of the female lobe wherein each of the sleeves is provided with the matching ribs and serration in an interior; and a cap movable connected with the male lobe and the female lobe the cap having a cap body, double latch pins or self-locking with a latch pin locator, a cover, a cap hinge provided with a pin and a relief step provided on the cap body proximal to the hinge pin, wherein the female lobe and the male lobe are connected by engaging the hinge with the twin hinges; and wherein an underside of the cap body is stepped in construction to accommodate the blade when assembled.

2. The crimping device of claim 1, wherein the crimping devices is configured to be assembled by engaging the latch finger of the female lobe in a space in the lower latch slot of the male lobe seamlessly.

3. The crimping device of claim 2, wherein the crimping tool comprises two scissor handles, a ratchet arm and a guiding arm to guide the continuous liner bag into the crimping device.

4. The crimping device claim 1, wherein, the crimping device is adapted to be assembled with a second, identical crimping device for use in a crimping process, by engaging the female lobe of the first crimping device with the male lobe of the second crimping device in a front to front assembly, while the blade of the first crimping device of the second crimping device and the flap of the first crimping device come opposite to the flap of the second crimping device.

5. The crimping device of claim 4, wherein, after assembly, the semi-circular openings are adapted to receive a continuous liner bag-containing toxic product for crimping using a crimping tool, wherein as the crimping tool is operated, the male lobe and female lobe move from an open position toward a close position, the slider starts moving in the slider slot and the twin ratchet finger enters the ratchet slot, wherein as the male lobe and female lobe close, the clamping force on the continuous liner bag-increases, and the continuous liner bag is shrunk and tightened inside the semi-circular opening of the crimping device, and wherein, once the continuous liner bag cannot compress further, the blade of crimping device cuts the continuous liner bag and the cap is turned over the open end of the crimping device, thereby ensuring that the dissected end of the continuous liner bag containing the toxic product is never exposed even during cutting.

6. The crimping device of claim 1 wherein the twin ratchet finger of the male lobe is split into an upper portion and lower portion, with a gap in between to have an expansion effect when engaged with a ratchet in the ratchet slot of the female lobe.

7. The crimping device of claim 1, wherein the slider of the male lobe is provided in a way to prevent the continuous liner bag from moving and clogging the hinges when the female lobe and the male lobe are forced to close by crimping tool.

8. The crimping device of claim 1, wherein the female lobe includes a canopy at a top, to cover any gaps between the female lobe and the male lobe, wherein the canopy overlaps the gaps and locates itself on a step provided on the male lobe covering any gaps left while crimping.

9. The crimping device of claim 1, wherein the male lobe includes an S flange Cover to cover any gaps at the one end of the twin ratchet finger and at the slider, wherein the S flange is configured to block any access to the twin ratchet finger to prevent any forceful opening, thus making the crimping device tamper-proof.

10. The crimping device of claim 1, wherein the male lobe, the female lobe and the cap are made of a material selected from PU, PVC, PP, and Nylon; and wherein the sleeves are made of a flexible material.

* * * * *